United States Patent [19]

Krob et al.

[11] 4,103,916

[45] Aug. 1, 1978

[54] BRAKE DEVICE FOR SKIS

[75] Inventors: Erwin Krob, Vienna; Erwin Weigl, Brunn am Gebirge; Josef Svoboda, Schwachat, all of Austria

[73] Assignee: TMC Corporation, Baar, Zug, Switzerland

[21] Appl. No.: 744,940

[22] Filed: Nov. 24, 1976

[30] Foreign Application Priority Data

Nov. 25, 1975 [AT] Austria ..... 8939/75

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,909,024 | 9/1975 | Salomon | 280/605 |
| 3,989,271 | 11/1976 | Riedel | 280/605 |
| 3,992,030 | 11/1976 | Salomon | 280/605 |
| 4,014,563 | 3/1977 | Weigl | 280/605 |

FOREIGN PATENT DOCUMENTS

| | | | |
|---|---|---|---|
| 2,228,506 | 12/1974 | France | 280/605 |
| 2,278,363 | 2/1976 | France | 280/605 |

*Primary Examiner*—David M. Mitchell

*Attorney, Agent, or Firm*—Blanchard, Flynn, Thiel, Boutell & Tanis

[57] ABSTRACT

A ski brake for skis utilizing a spring construction such as is illustrated in U.S. Pat. No. 4,014,563. The spring is composed of a U-shaped portion having a pair of generally parallel legs and a connecting cross-part. The heel holder of a ski binding has a projection thereon which cooperates with the U-shaped part to effectively hold down the ski brake in the cocked or ready position without requiring a direct engagement of the ski boot with the U-shaped part.

7 Claims, 7 Drawing Figures

BRAKE DEVICE FOR SKIS

FIELD OF THE INVENTION

The invention relates to a brake device for skis which includes a brake member which is pivotally supported on the ski, and which brake member can be moved automatically under spring action into a braking position and in this position projects over the ski with downwardly directed brake legs, whereby each brake leg is constructed with two extensions of which the first extension extends below a holding plate which is secured to the ski and subsequently extends to a step-on member and the second extension is directly associated with the step-on member, whereby at least the first extension consists of a spring steel wire and the part associated with the holding plate serves as a bearing, such as is illustrated in U.S. Pat. No. 4,014,563.

BACKGROUND OF THE INVENTION

The above-described brake device has proven itself in the field. However, it has the disadvantage that the stepping down of the brake, namely the swinging of the brake legs into the cocked or ready position and the holding of same down in this position is done by the ski boot. For this purpose, the step-on member of the known brake device has a stepping plate which must also function to pull in the brake legs above the ski surface. For this purpose, the stepping plate has a breaking point, which causes a bent-leverlike operation. Both the utilization of the stepping plate in connection with the ski boot and also the extending of the known brake device have disadvantages. To hold down the brake device by means of the ski boot means a constant strain for the skier; the construction of the breaking point in the stepping plate requires the use of a high-grade material, which will resist both the extending strains and also has favorable sliding characteristics. The entire brake device together with the stepping plate must thereby be arranged below the ski boot, which unfavorably increases the position of the ski boot relative to the ski.

The object of the present invention is to make an improvement to remedy and to overcome the mentioned disadvantages. The inventive construction thereby permits a control of the known brake device independent from the ski boot.

The object is achieved by use of spring steel wire, as is actually known, constructed approximately U-shaped and having a cross-part forming the step-on member and by a second extension section extending with its preferably free ends under the two legs of the U-shaped spring steel wire, furthermore by the step-on member being associated with a projection of a heel holder, by which the legs are lifted during a closing of the heel holder into the cocked or ready position above the upper ski surface and is pulled in laterally in this position.

All objects are achieved by the inventive development of the abovementioned brake device. Mainly, the brake device is controlled directly by the heel holder so that neither an extendable stepping plate is required nor occurs the elevation of the position of the ski boot relative to the ski. Also the brake device does not need to be held down separately any longer by the ski boot, because it is held in the cocked or ready position exclusively by the spring force of the heel holder.

BRIEF DESCRIPTION OF THE DRAWINGS

Further advantages and details of the invention will now be described more in detail in connection with the drawings which illustrate one exemplary embodiment and in which.

DETAILED DESCRIPTION

Figure 1:
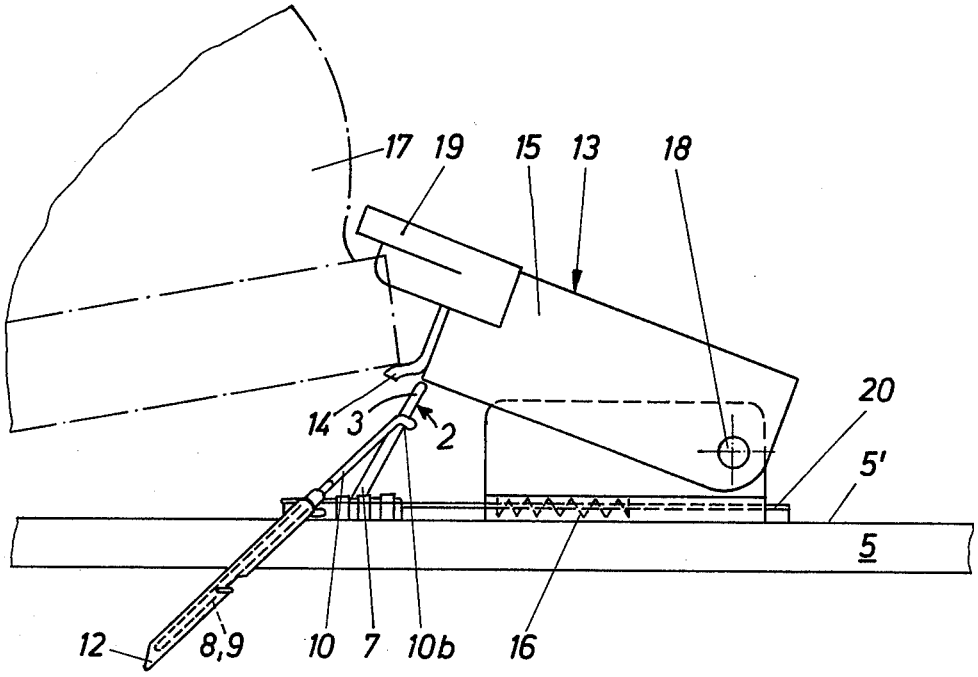
FIGS. 1 and 2 are side and top views, respectively, of the inventive ski brake device in a braking position.

As one can recognize from the drawings, the cross-part 1 of a U-shaped constructed spring steel wire is constructed as a step-on member 2. The spring steel wire has generally parallel legs 3 extending into a center recess 4 in a holding plate 6 which is secured to the ski 5. The two legs 3 become bent outwardly away from each other in the center recess 4 to form extensions 7 which extend beneath the holding plate 6 in recesses 6A and function as pivot bearings about which the legs 3 and cross-part 1 are pivoted. The extensions 7 become bent again laterally outside the plate 6 to form brake legs having sections 8 and 9, the sections 9 each being connected to the section 8 and being bent backwardly at 180°. The sections 9 extend through a second extension section 10 bent at an angle to the section 9 back toward the step-on member 2. The free ends **10*a*, 10*b* of the extension 10 extend beneath the two legs 3 of the U-shaped spring steel wire and allow a sliding movement of the ends along the legs (see FIGS. 2 and 5**).

The sections 8 or the bent-back sections 9 of the spring steel wire, which each form the brake legs, are additionally reinforced by a clamp 11 encircling both wire sections. Furthermore, the brake legs are housed in a unitary plastic housing 12. The construction of the present brake device is identical to the construction illustrated in U.S. Pat. No. 4,014,563, except for the construction of the step-on member 2 (referred to as the stepping plate in the aforementioned patent.

According to the present invention, the step-on member 2 is associated with a projection 14 on a heel holder 13. The heel holder 13 may be of any desired construction, assuming that its hold-down part 19 permits a sufficiently free movement of the wire sections 3 and 10 in the upward direction and carries out an adjustment against spring force in the longitudinal direction during a closing of the binding. Two thrust springs 16 exist in the present example, which thrust springs permit, during a stepping in of the ski boot 17, which is only symbolically illustrated in broken lines, into the ski binding, a longitudinal adjustment of the heel holder 13 on a rail 20 fixed to the ski 5. It is to be understood that it is also possible to use one thrust spring or also several thrust springs. The holding part 19 is arranged in a conventional manner on the housing 15 of the heel holder 13 which is pivotal about a pivot axis 18 extending transversely with respect to the longitudinal axis of the ski 5.

Figure 2:
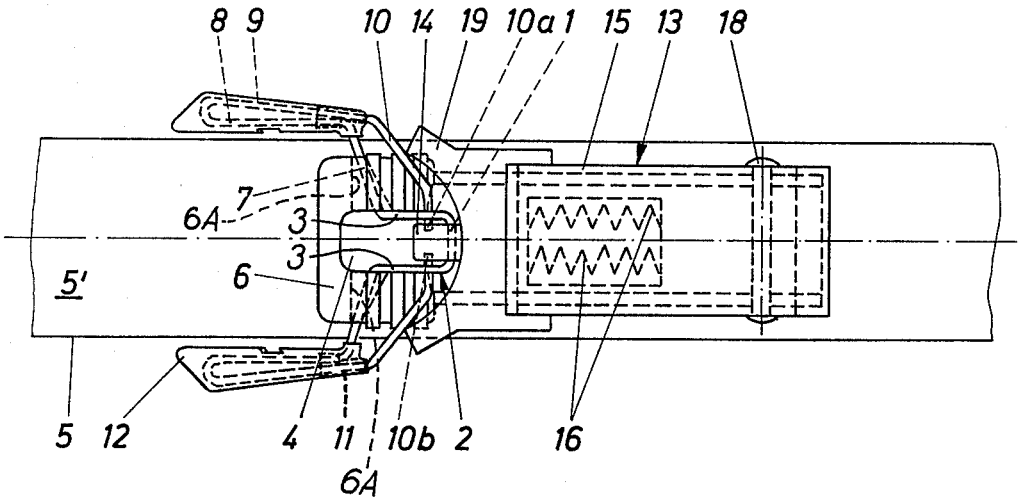
Figure 3:
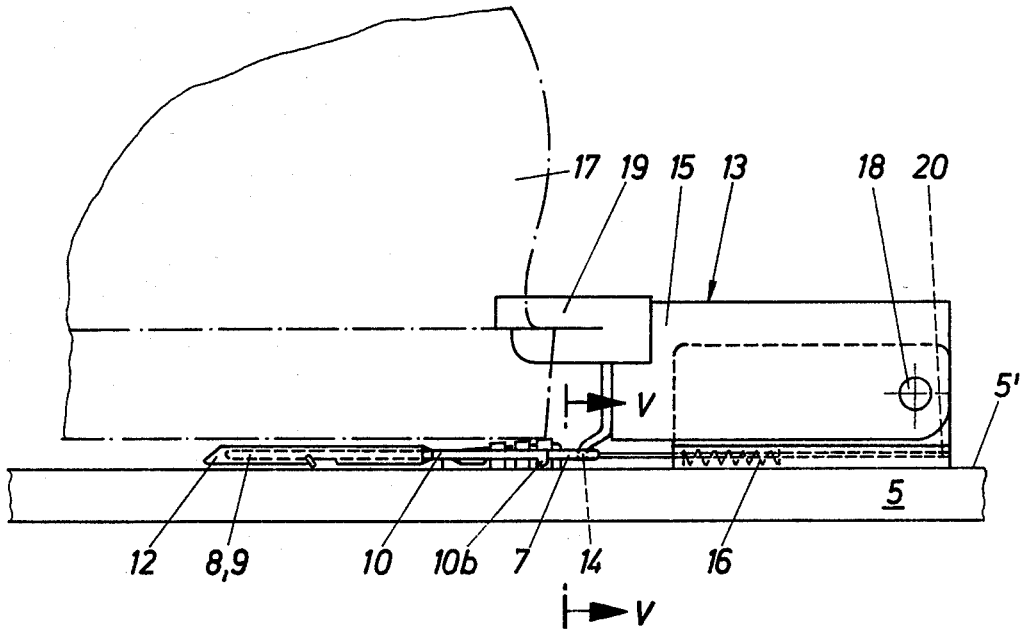
FIGS. 3 and 4 are side and top views, respectively, of the ski brake device illustrated in FIGS. 1 and 2, however, in the closed position.
Figure 4:
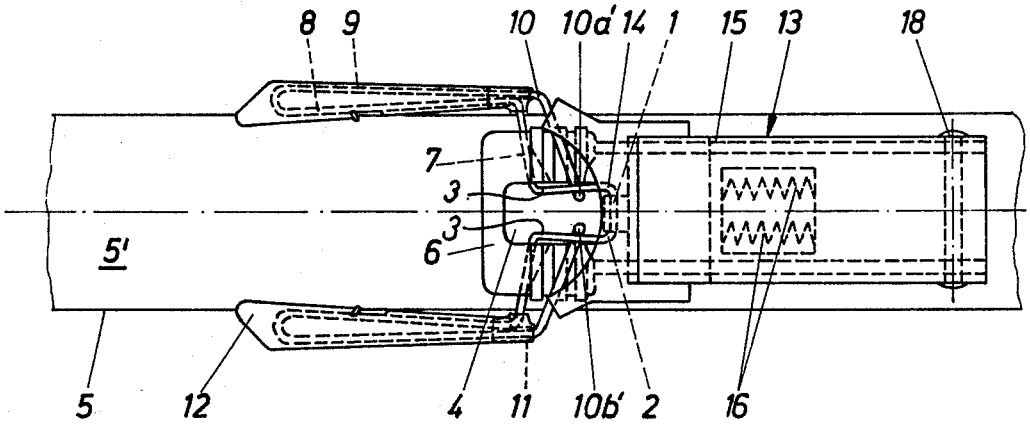

The comparison of the two positions illustrated in FIGS. 1 and 2 on the one hand and illustrated in FIGS. 3 and 4 on the other hand shows that during stepping in and down by the ski boot 17, the projection 14 engages and presses down the step-on member 2, lifts the brake leg sections 8 and 9 above the upper surface of the ski 5 and in the last stage of stepping down moves the heel holder 13 backwardly against the force of the springs 16 so that the extensions 7 in the holding plate 6, which serves as bearings, become reoriented in the openings 6A to cause the free ends of the two brake legs 8,9 to be forced laterally inwardly over the upper surface of the ski 5. This method of operation is actually known from U.S. Pat. No. 4,014,563 and does not need to be discussed any further.

Figure 5:
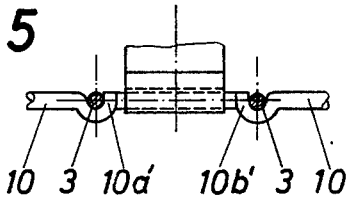
FIG. 5 is a partial cross-sectional view taken along the line V—V of FIG. 3.

FIG. 5 illustrates another example of how the free ends 10*a'* and 10*b'* are bent into a half ring to grip under the two legs 3 of the U-shaped spring steel wire. However, this embodiment is not absolutely needed because the free ends 10*a* and 10*b* can simply extend beneath and grip the legs 3 as was indicated in FIGS. 1 and 2. The modification incorporating the half rings 10*a'* and 10*b'* has the advantage of an increased security in maintaining the overlap between the sections 10 and the step-on member 2.

The invention is not limited to the illustrated exemplary embodiments. Variation possibilities are conceivable without departing from the spirit of the invention. For example, the holding plate for the brake device can be constructed to simultaneously serve as a low friction sliding plate for the sole of the ski boot. It is also possible to join the free ends 10*a* and 10*b* of the extensions 10 which extend beneath the legs by means of a pipe piece or tube, so that one end in the pipe piece is fixedly connected to one free end 10*a*, for example, and the other end is movable both relative to the other free end 10*b* and transversely with respect to the longitudinal axis of the ski 5. Through this construction, the change in the spacing which occurs as a result of the swinging from the cocked or ready position into the braking position or vice versa, is accommodated.

Figure 6:
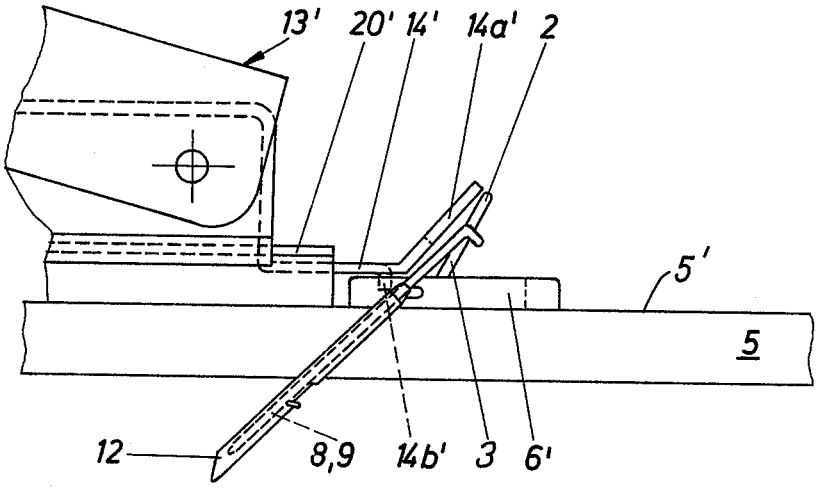
FIGS. 6 and 7 are side and top views, respectively, of a further exemplary embodiment in a braking position.
Figure 7:
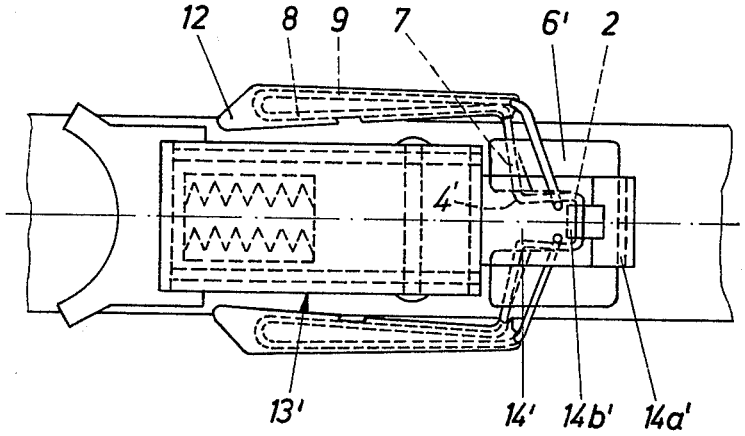

A further exemplary embodiment of the inventive brake device is illustrated in FIGS. 6 and 7, whereby FIG. 6 is a side view of the device in the braked position of the brake device and FIG. 7 is a top view of the brake device in the closed position (namely the cocked or ready position). The parts in this exemplary embodiment have been identified to correspond with the reference numerals used in FIGS. 1 to 5, with the difference that differently constructed parts, which however perform the same function, have a prime (') as a suffix.

In the exemplary embodiment according to FIGS. 6 and 7, the rear part of the heel holder 13' has an extension, which is constructed as a projection 14'. The projection 14' has the branches 14*a'* and 14*b'*. The rear end of the rail 20', on which the heel holder 13' is longitudinally adjustably supported, is elevated in vertical direction so that the downwardly extending tab 14*b'* projects into the operating plane of the ski brake. The other branch 14*a'* extends inclined upwardly and engages the step-on member 2. In this case the holding plate 6' has a throughway or groove 4' in the front area, so that the free end 14*b'* of the projection 14' is received in and can be moved in longitudinal direction between the two halves of the holding plate. A construction would also be possible in which the holding plate 6' does consist of one piece, however, has in the center area a recess which serves as a passageway corresponding to the earlier described passageway 4'.

This embodiment is operated in such a manner that the inclined upwardly projecting branch 14*a'* engages and presses the step-on member 2 downwardly upon a rearward movement of the heel holder 13'. The ski brake is thereby pivoted in the known manner about an axis defined by the extensions 7 until the legs 3 become substantially parallel to the upper ski surface 5' of the ski 5. During a further rearward movement, the downwardly projecting tab 14*b'* of the projection 14' comes into play and exerts a pressure onto the cross-part 1 of the step-on member 2. The legs 8,9 are pulled inwardly above the upper ski surface 5' by this force. The pulled-in position is illustrated in FIG. 7.

This exemplary embodiment has the further advantage that the ski brake can be arranged behind the heel holder and through this the holding plate for the ski brake can be designed independent from the sliding plate for the ski boot. A further advantage lies in that the projection which is arranged in the rear area can for operating the ski brake also be installed at a later date and on such ski bindings which have no projection for stepping in.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake for a ski including a brake member having a pair of brake legs, said brake member being pivotally supported on said ski for movement between a ready position and a braking position and which can be moved under spring action automatically into said braking position and in this position said brake legs project downwardly over said ski, each brake leg being constructed with two extensions wherein a first extension includes a part projecting under a holding plate secured to said ski and thereafter is attached to a step-on member and wherein a second extension is directly engaged with said step-on member, wherein at least said first extension consists of spring steel wire and said part which projects under said holding plate serves as a bearing, the improvement comprising a heel holder and support means for supporting said heel holder for movement on said ski in a direction parallel to the longitudinal axis of said ski, wherein said spring steel wire is approximately U-shaped having a pair of legs and a cross-part interconnecting said legs, wherein said U-shaped spring steel wire forms said step-on member, wherein said second extension extends beneath the associated one of said two legs of said U-shaped spring steel wire, and wherein a projection is provided on said heel holder, said projection engaging said step-on member to effect a lifting of said brake legs into said ready position above the ski surface by closing said heel holder and to further effect simultaneous with the closing a pulling in of the brake legs over the upper surface of the ski.

2. The improved brake device according to claim 1, wherein said heel holder includes a thrust spring for urging said heel holder longitudinally on said support means toward said ski brake, wherein said support means includes pivot means for pivotally supporting said heel holder for movement about an axis extending transversely of the longitudinal axis of said ski, wherein said brake legs are pulled up and inwardly in response to a pivotal downward movement and longitudinal movement of said heel holder against the force of said thrust spring during an engagement of a ski boot with said heel holder.

3. The improved brake device according to claim 1, wherein said second extension terminates in free ends beneath said two legs of said spring steel wire and includes means for slidingly engaging said two legs.

4. The improved brake device according to claim 3, wherein said means for slidingly engaging said two legs extends only slightly over half the circumference of each leg.

5. The improved brake device according to claim 1, wherein said projection is arranged at the rear end of said heel holder, and is operatively connected with said brake member arranged behind said heel holder.

6. The improved brake device according to claim 5, wherein said projection is formed with branches, the one end of which is supported on said step-on member of said brake member and the other end of which projects in the pivoted position of said brake legs upwardly, into the operating plane of the brake member.

7. The improved brake device according to claim 1, wherein said support means includes a rail on which said heel holder is longitudinally movable and has at least in the rear area an angled section, which creates a free space between the same and the ski surface.

* * * * *